US007261149B2

(12) United States Patent
Nail

(10) Patent No.: US 7,261,149 B2
(45) Date of Patent: Aug. 28, 2007

(54) HEAT EXCHANGER WITH PIPE COILS AND HELICAL SPREADER RIBS

(75) Inventor: Claude Nail, Etriche (FR)

(73) Assignee: P.S.A. (FR)

( * ) Notice: Subject to any disclaimer, the term of this patent is extended or adjusted under 35 U.S.C. 154(b) by 69 days.

(21) Appl. No.: 11/186,285

(22) Filed: Jul. 21, 2005

(65) Prior Publication Data

US 2006/0016586 A1 Jan. 26, 2006

Related U.S. Application Data

(60) Provisional application No. 60/591,245, filed on Jul. 26, 2004.

(30) Foreign Application Priority Data

Jul. 22, 2004 (FR) ..... 04 08119

(51) Int. Cl.
*F28D 7/02* (2006.01)

(52) U.S. Cl. ..... 165/163; 165/159

(58) Field of Classification Search ..... 165/157, 165/159–161, 163

See application file for complete search history.

(56) References Cited

U.S. PATENT DOCUMENTS 1,776,135 A * 9/1930 Smith ..... 122/476
1,893,484 A 1/1933 Belt
3,700,030 A 10/1972 Bosquain et al.
4,013,402 A 3/1977 Klein et al.
5,379,832 A 1/1995 Dempsey
6,027,241 A * 2/2000 King ..... 366/181.5

FOREIGN PATENT DOCUMENTS

FR 2 096 804 3/1972
FR 2 686 408 7/1993
WO WO 00/79200 A1 12/2000

* cited by examiner

*Primary Examiner*—Teresa J. Walberg
(74) *Attorney, Agent, or Firm*—Dean W. Russell; Kilpatrick Stockton LLP

(57) ABSTRACT

Addressed is a heat exchanger including a housing having an internal wall defining at least one internal chamber incorporating at least one core having a wall defining in the chamber, with the internal wall of the housing across from it, at least one exchange cavity including at least one tubular hollow coil having ends passing through the housing to make it possible for it to be supplied with a primary fluid, at least one inlet and at least one outlet that are axially opposite for circulation of a secondary liquid in the exchange cavity in contact with each coil and at least one tangential spreader rib, extending in projection with respect to a wall across from the coil and not parallel to the axial circulation direction, but adapted in order not to inhibit the circulation of the secondary liquid. The thermal exchanger includes at least one tangential helical rib and at least one coil having different winding directions.

22 Claims, 8 Drawing Sheets

HEAT EXCHANGER WITH PIPE COILS AND HELICAL SPREADER RIBS

CROSS-REFERENCE TO RELATED APPLICATIONS

This application claims priority to U.S. Provisional Application No. 60/591,245 entitled "Coil Type Heat Exchanger With Screw-Shaped Separating Ribs" filed on Jul. 26, 2004 and French Patent Application No. 04.08119 filed on Jul. 22, 2004, the contents of which are incorporated herein by reference.

BACKGROUND OF THE INVENTION

The invention relates to a heat exchanger for heating or cooling a secondary liquid using a primary fluid circulating in at least one helical tubular pipe coil arranged in at least one exchange cavity in which the secondary liquid circulates.

An exchanger such as this can be used, for example, as a heat pump condenser for reheating the water in a swimming pool. FR-2 686 408 thus describes an example of such a heat exchanger with pipe coil that comprises spreaders in the form of longitudinal bands forming seats for the convolutions of the pipe coil. Such spreaders actually make it possible to center the pipe coil in the exchange cavity and to optimize the circulation of the secondary liquid around the pipe coil convolutions.

An exchanger such as this is satisfactory, but it is desirable to improve the thermal performance while minimizing its general dimensions and thus its costs and its space requirement.

BRIEF DESCRIPTION OF THE INVENTION

The invention thus provides, in a general manner, for a heat exchanger with pipe coils of which the thermal performances—in particular the useful heat returned—are improved in comparison to prior exchangers and do so with general dimensions that are equivalent or reduced.

DETAILED DESCRIPTION OF THE INVENTION

The invention more specifically provides for achieving this goal in a simple and economical manner and without having a negative effect on the other exchanger qualities (service life, ease of installation, etc.).

In order to do this, the invention concerns a heat exchanger comprising:

an outer housing comprising an internal wall defining at least one internal chamber, incorporating at least one core having one wall defining, in the chamber, with the internal wall of the housing across from it, at least one exchange cavity, in each exchange cavity at least one tubular hollow helical pipe coil having ends that pass through the housing in order to be able to be supplied with a primary fluid circulating in this coil, at least one inlet at one axial end of the exchange cavity and at least one outlet at the other opposite axial end of the exchange cavity, in such a way that a circulation of secondary liquid can be established in an axial circulation direction in the exchange cavity between this inlet and this outlet, in contact with and on the outside of each coil that it holds, spreader elements of each coil and of the internal wall of the housing and/or of the wall of the core across from it, wherein these spreader elements comprise at least one spreader rib, called the tangential rib, extending in projection with respect to a wall oriented across from the corresponding coil and not parallel to the axial circulation direction, but being adapted so that it does not inhibit any circulation of the secondary liquid along the axial circulation direction between the said wall and the coil.

In the heat exchanger according to the invention, the spreader elements comprise at least one tangential rib with helical shape and this tangential helical rib and this coil have different winding directions in such a way as to be in contact with contact zones that are essentially punctiform. The inventors have actually confirmed that this specific structure makes it possible to considerably, and in an unexpected manner, improve the thermal performance of the exchanger. In particular, the inventors have confirmed a 5% to 10% improvement in the exchanger thermal power. The inventors are unable to give any clear explanation for this result. However, it is likely that such tangential ribs—in particular helical ones—would have the effect of increasing the dwell time of the secondary liquid in the exchange cavity without creating a loss of feed by promoting the contact and the exchange surface with the coil.

Advantageously, and according to the invention, the tangential helical rib and the coil have different pitches in such a way that they are in contact in contact zones that are essentially punctiform.

As a variation, it is possible to provide at least one rib in the form of a toroidal section or with an annular portion with a non-circular cross section (e.g. polygonal) extending over a section of less than 360 degrees around the axial direction.

In an advantageous embodiment according to the invention, the winding direction of at least one tangential helical spreader rib is opposite to that of the coil across from it. Advantageously, and according to the invention, the pitch of at least one tangential helical spreader rib is between 1.5 to 3 times that of the coil across from it.

Besides that, advantageously and according to the invention, each core comprises at least one tangential spreader rib, called the interior rib. This interior rib comes in contact with the interior surface of the coil oriented toward its axis of symmetry. In addition, advantageously and according to the invention, in each exchange cavity, the interior wall of the housing has at least one tangential spreader rib, called the exterior rib. This exterior rib comes in contact with the exterior surface of the coil located the furthest toward the outside, radially with respect to its axis of symmetry.

In particular, advantageously and according to the invention, in at least one exchange cavity, the core has at least one interior tangential spreader rib and the internal wall of the housing has at least one exterior tangential spreader rib. Preferably, advantageously and according to the invention, each exchange cavity has at least one interior rib and at least one exterior rib.

Besides that, advantageously, the exchanger according to the invention is characterized in that the exchange cavity has an interior helical rib and an exterior helical rib and in that the pitch of the interior rib is different from the pitch of the exterior rib. Advantageously and according to the invention, the pitch of the exterior rib is greater than the pitch of the interior rib, which itself is greater than the pitch of the coils contained in the exchange cavity.

Advantageously and according to the invention, the exterior rib and the interior rib have the same winding direction.

In addition, advantageously and according to the invention, at least one exchange cavity is provided with at least one series of blocks adapted so that they can be intercalated between the convolutions of the coil in such a way as to maintain the relative axial spread. Advantageously, and according to the invention, the exchange cavity has the blocks projecting radially from the inner wall of the housing.

Also, advantageously and according to the invention, for each internal chamber the housing comprises two shells each forming one half of a cylinder and assembled together by an axial joint plane. This facilitates the assembly of the coil and of the core in the chamber, which is carried out by putting one of the shells in place then closing the chamber by covering it with the other shell and sealing the assembly—in particular by welding—of the two shells along their axial joint plan.

Besides that, advantageously and according to the invention, the housing is provided with passage holes for the ends of the coil, orthogonal to the axis of the internal chamber. The exchanger according to the invention thus has a reduced axial space requirement and its installation is simple, fast and reliable. Besides that, this prevents any errors in the direction of attachment of the coil to the source of primary fluid.

In an advantageous embodiment, the exchanger according to the invention comprises a single exchange cavity holding a single coil, the exchange cavity having a radial size corresponding at least essentially the total of the radial thickness of the exterior and interior tangential ribs and the diameter of the cross section of the tube forming the coil.

Advantageously and according to the invention, at least one internal chamber, the internal wall of the corresponding housing, each core and its wall, the exchange housing, each coil and each tangential rib are completely cylindrical, in particular revolution cylindrical, around the same axis parallel to the axial circulation direction.

Besides that, advantageously and according to the invention, the radial size of an exchange cavity is on the order of 10 mm to 15 mm and the exterior diameter of the cross section of the tube forming the coil of this exchange cavity is on the order of 7 mm to 13 mm and the radial thickness of each tangential spreader rib is between 1 mm and 3 mm.

Advantageously and according to the invention, the housing and each core are made of a molded synthetic material and each coil is formed of a metal or metal alloy.

The invention also concerns a heat exchanger characterized in combination of all or part of the characteristics mentioned above or below.

BRIEF DESCRIPTION OF THE DRAWINGS

Other goals, characteristics and advantages of the invention will become clear from reading the following description, which refers to the attached figures showing the embodiments of the invention given by way of non-limiting example, in which.

DETAILED DESCRIPTION OF THE DRAWINGS

Figure 1:
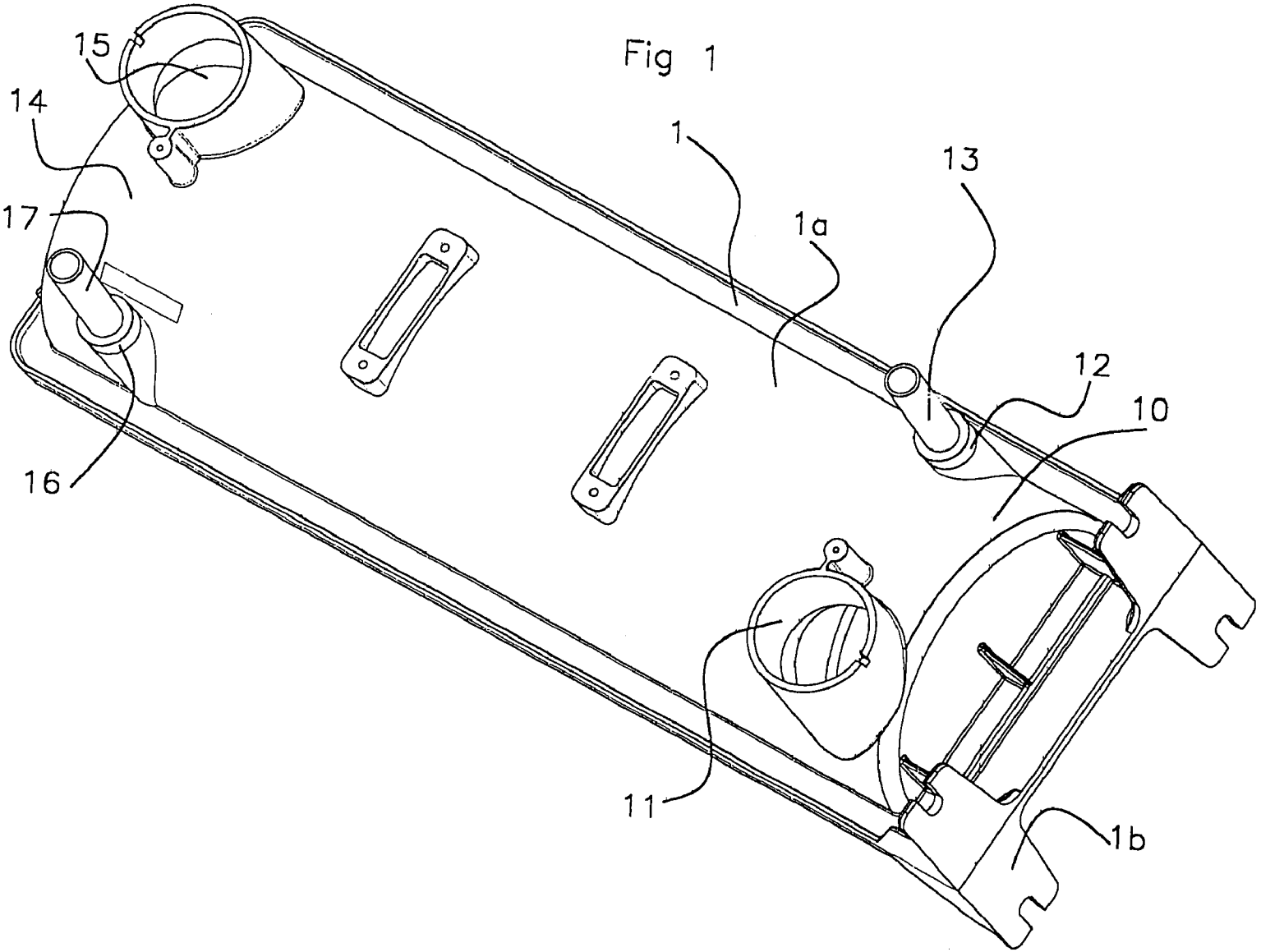
FIG. 1 is a perspective schematic view of an exchanger according to a first embodiment of the invention.
Figure 2:
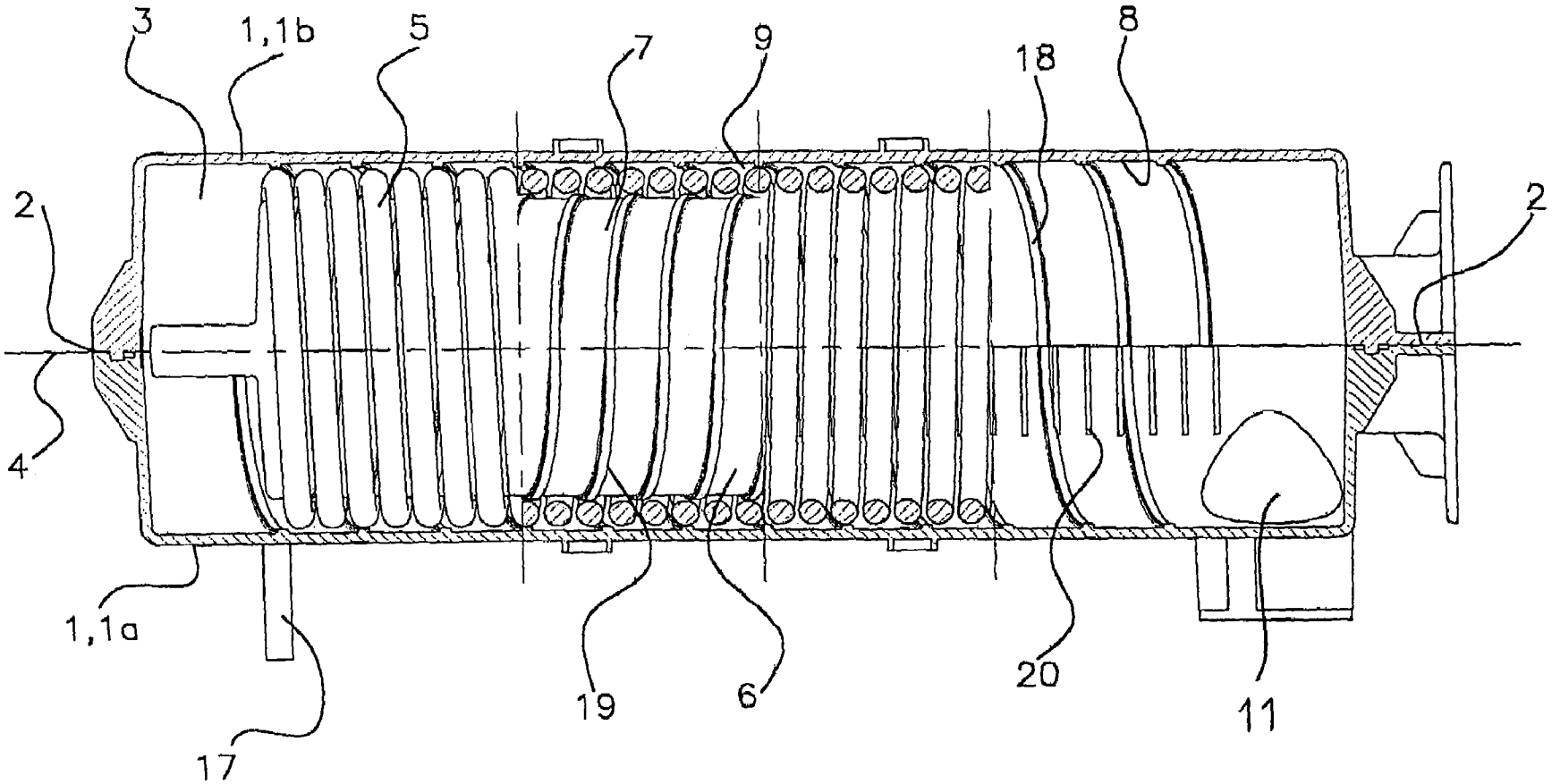
FIG. 2 is a schematic view in axial cross section of a first embodiment of an exchanger according to a first embodiment of the invention, with different portions representing, from left to right, the coil and the core in place and in perspective; the coil in cross section and the core in perspective; the coil in cross section without the core; neither the coil nor the core to illustrate the spreader organs.
Figure 3:
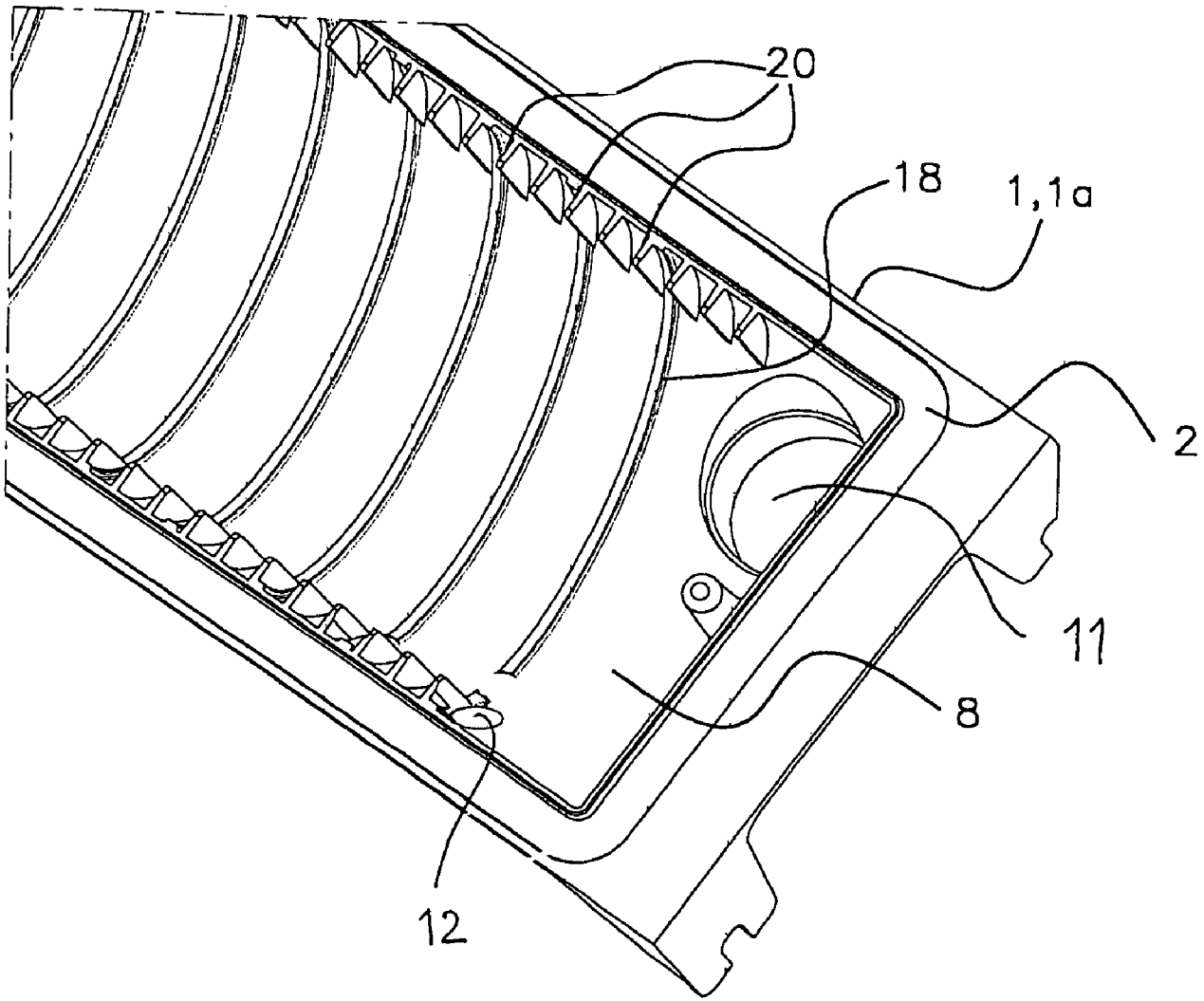
FIG. 3 is a partial schematic view in perspective of a housing block of the exchanger in FIGS. 1 and 2.
Figure 4:
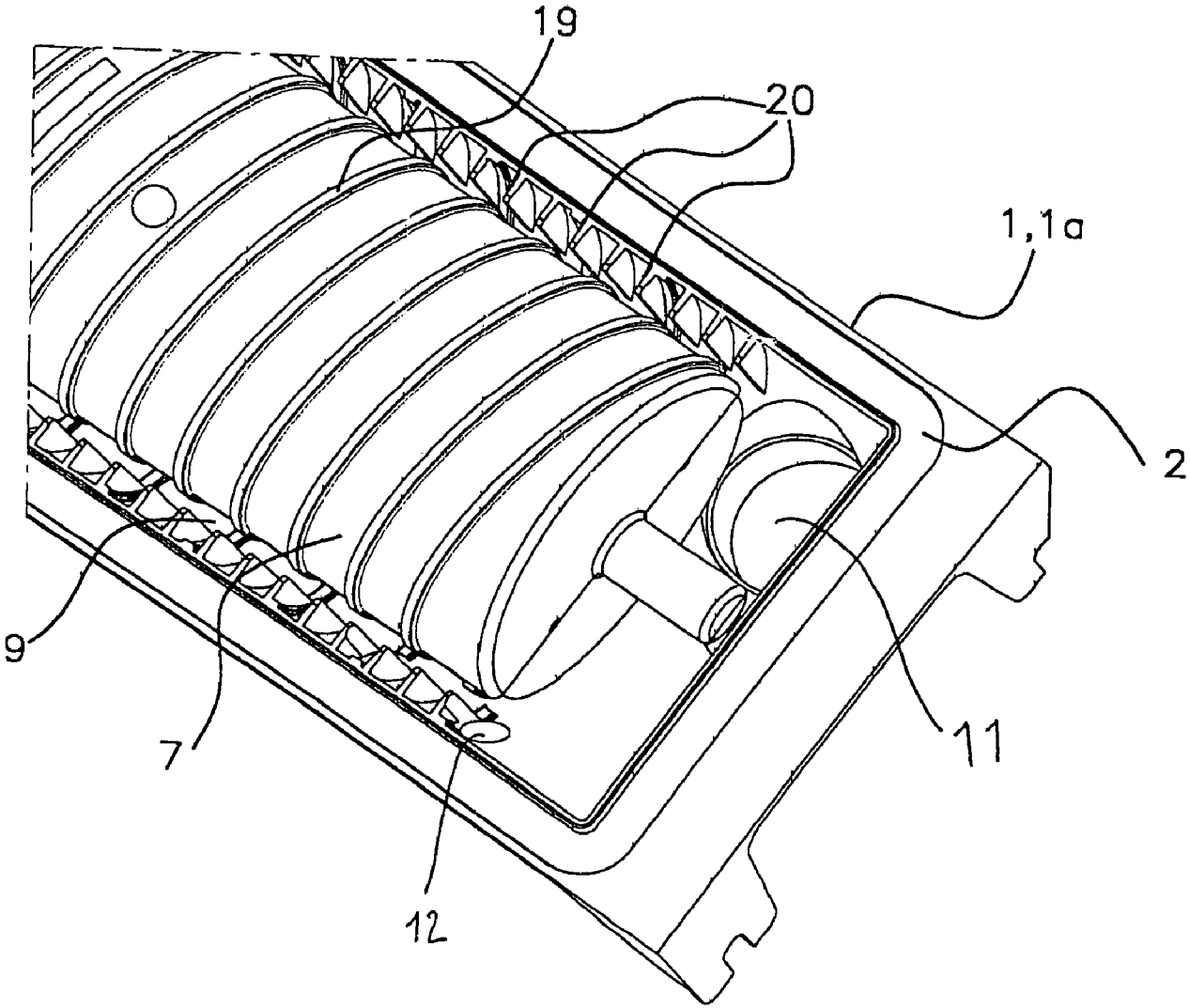
FIG. 4 is a partial schematic view in perspective of a housing block of the exchanger similar to FIG. 3 with the core in place, but without the coil, solely for the purpose of illustration.
Figure 5:
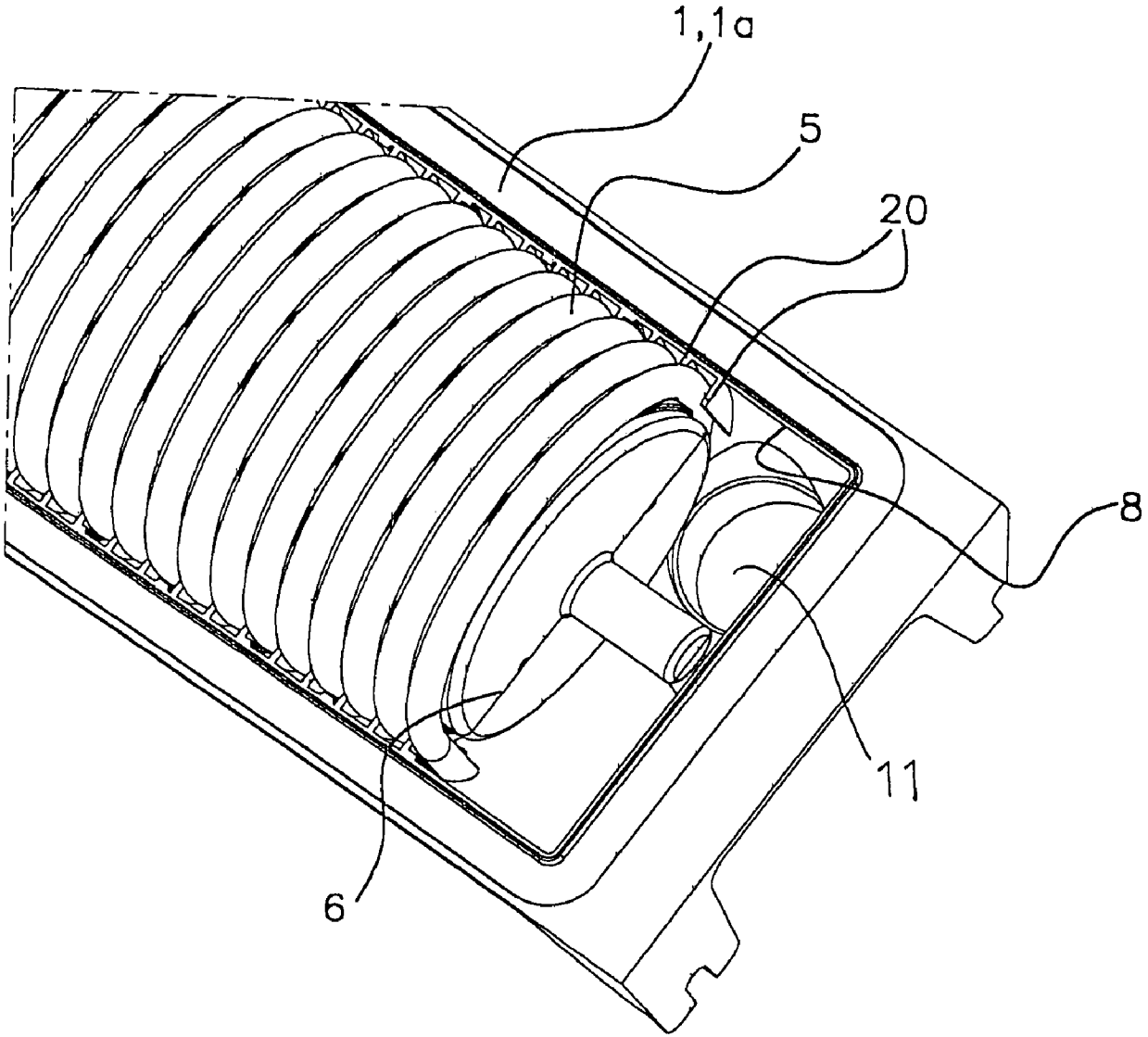
FIG. 5 is a partial schematic view in perspective of a housing block of the exchanger similar to FIG. 3, with the coil and the core in place.
Figure 6:
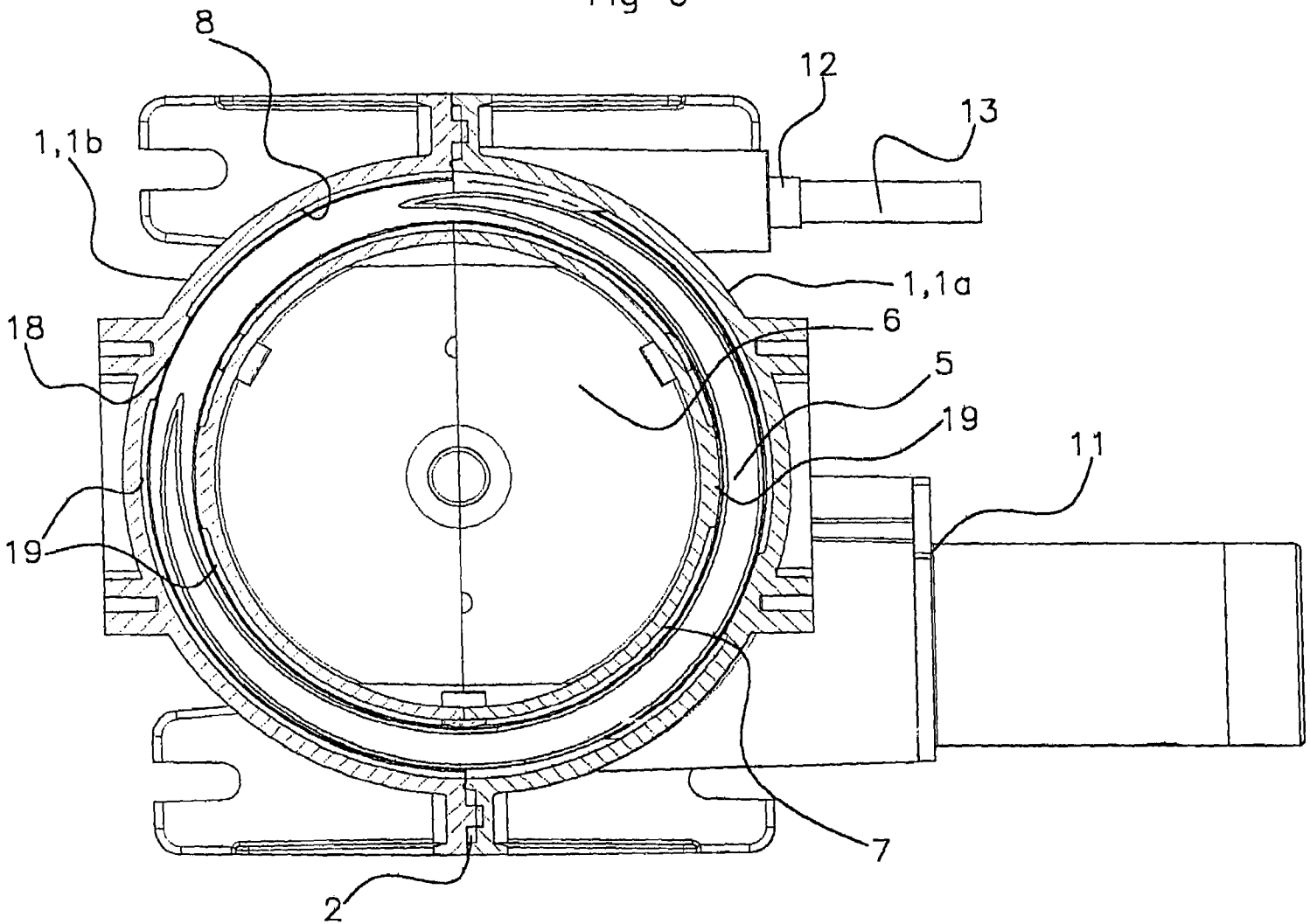
FIG. 6 is a schematic transverse cross section view of the exchanger from FIG. 2, FIGS. 7 to 9 are plane views representing a coil, a core and a shell of an exchanger, respectively according to a second embodiment.

The figures represent different embodiments of a heat exchanger according to the invention that can be used, for example, as a condenser in a heat pump for reheating the water in a swimming pool.

This exchanger comprises an external housing 1 formed of two shells, 1*a*, 1*b* of rigid material, preferably of a synthetic material, assembled together by an axial peripheral joint plane 2. The housing 1 defines a revolution-cylindrical internal chamber 3 that is globally symmetrically around an axis 4 and the joint plane 2 is a diametric plane of the internal chamber 3 and the axis 4.

One 1*a* of the two shells 1*a*, 1*b* is equipped with inlets and outlets passing through, on one hand, for the ends of at least one coil 5 incorporated in the internal chamber 3 and, on the other, for a secondary liquid that can circulate in the internal chamber 3, in contact with coil(s) 5. In the examples shown in FIGS. 1 to 6 and 10 to 12, a single coil 5 is incorporated in the internal chamber 3.

The internal chamber 3 also encloses a cylindrical core 6 with coaxial revolution, i.e. having a revolution-cylindrical wall 7 around the same axis 4 as the chamber 3. The housing 1 also has a revolution-cylindrical internal wall 8 that is globally symmetrical around axis 4, defining the internal exchanger 3.

Thus, a revolution-cylindrical annular exchange cavity 9 that is globally symmetrical around the same axis 4 is defined between the internal wall 8 of the housing 1 and the wall 7 of the core 6, namely between the two axial ends of chamber 3.

On one 10 of its axial ends, the shell 1*a* has a passage hole 11, communicating between the outside and the exchange cavity 9, for passage of the secondary liquid and a passage hole 12 also communicating between the outside and the exchange cavity 9 for the passage of one end 13 of the coil 5 for circulation of a primary fluid in this tubular hollow helical coil 5.

In the same way, at the other axial end 14 of the shell 1*a*, a passage hole 15 is provided that communicates between the outside and the exchange cavity 9 for passage of the secondary liquid, and a passage hole 16 communicating between the outside and the exchange cavity 9 for the passage of another end 17 of the coil 5.

The shells 1*a*, 1*b* each form half of the cylinder and the joint plane 2 is rectangular overall. Preferably, the holes 11, 15 for the passage of secondary liquid located at the opposite ends 10, 14 are diagonally opposed with respect to the joint plane 2.

In the same way, the holes 12, 16 for the passage of the ends of coil 5 are preferably diagonally opposed with respect to the rectangular joint plane 2. Besides that, it should be noted that the passage holes 12, 16 for the ends 13, 17 of the coil 5 across the housing 1 are orthogonal to the axis 4 of the internal chamber 3. This arrangement makes it especially easy to install the coil 5, to prevent any connection errors concerning the direction of primary fluid circulation and, in addition, to reduce the axial space requirement of the exchanger according to the invention.

The coil 5 is preferably of the tubular hollow helical type with non-contiguous convolutions wound around an axis of symmetry that coincides with the axis 4 when the coil 5 is in place in the exchange cavity 9. It should be noted that the coil 5 may have a series of convolutions wound in a single direction between its two axial ends, or in contrast several series of convolutions, one around the other, i.e. several cylindrical thicknesses of coaxial convolutions forming the supply-return of the primary fluid to the interior of the exchange cavity 9.

Figure 7:
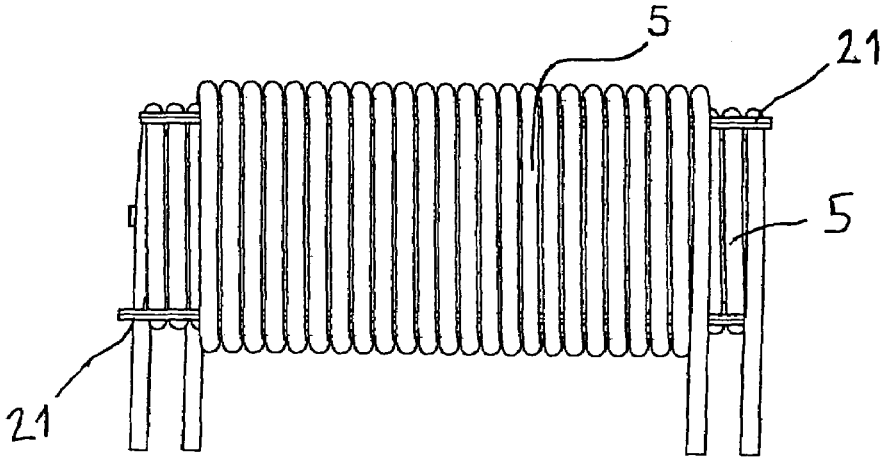
Figure 8:
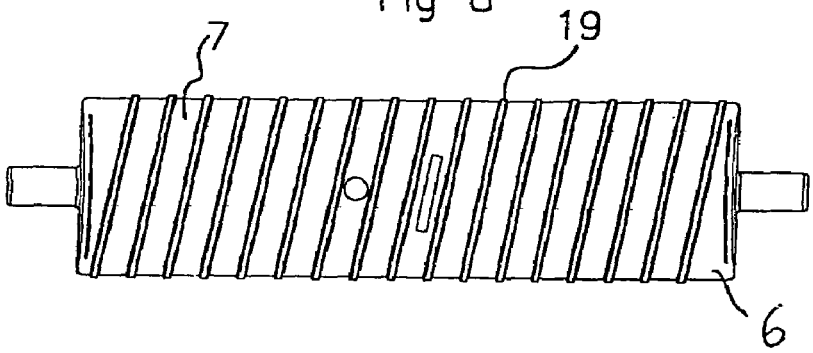
Figure 9:
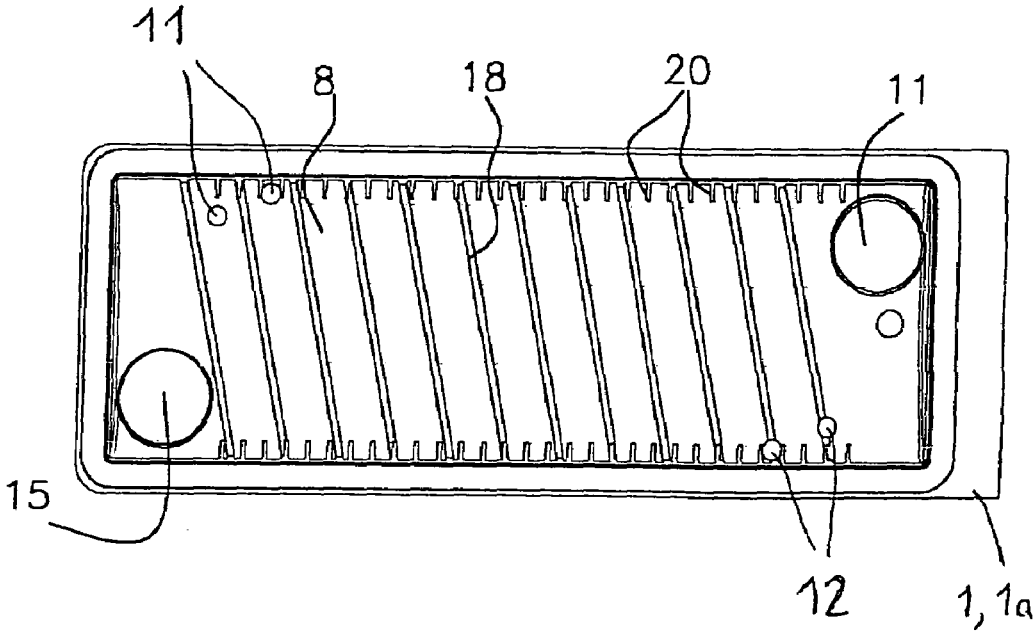
Figure 10:
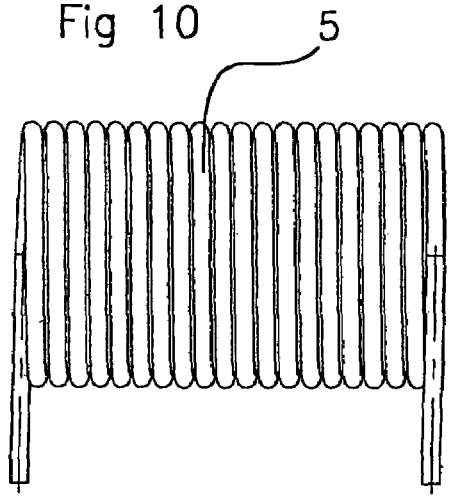
FIGS. 10 to 12 are plane views showing a coil, a core and a shell of an exchanger, respectively according to a third embodiment.
Figure 11:
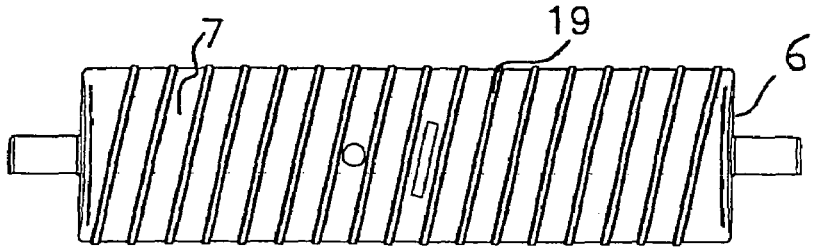
Figure 12:
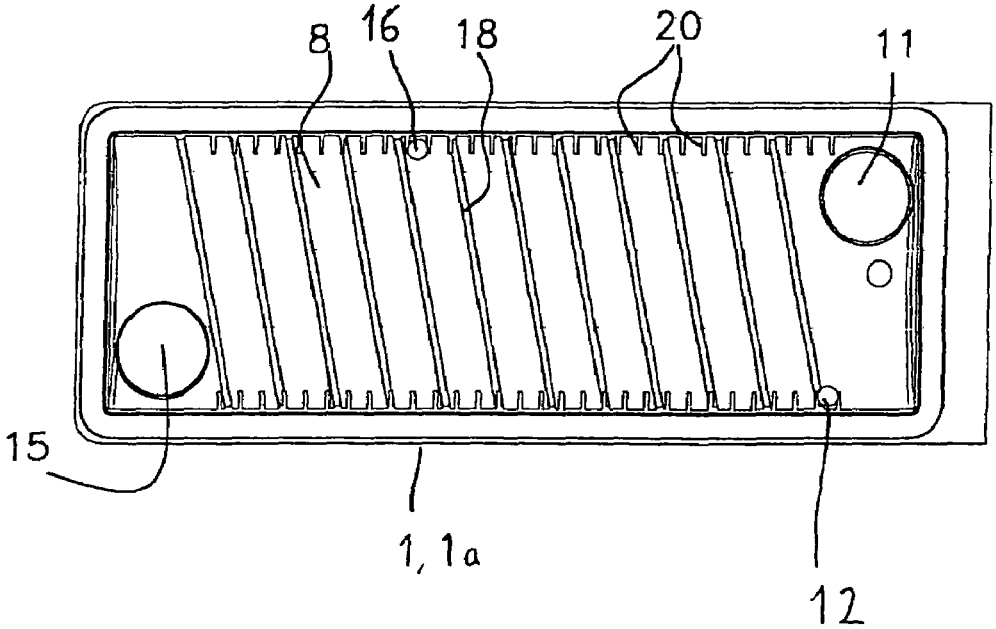

Several coaxial coils 5 can also be provided, as in the second embodiment shown in FIGS. 7 to 9, where the exchanger comprises two coaxial coils 5. In this case, the shell 1*a* has at its axial end 10, two holes 12 for passage of the ends 13 of the two coils 5 and at its other axial end 14, two holes 16 for the passage of the other ends 17 of the two coils 5. Two independent circulations of primary fluid can thus be implemented in the exchange cavity 9, one in each coil 5. The longitudinal spreader rods 21, i.e. parallel to the axis 4, are preferably placed between the two coaxial coils 5.

Each coil 5 can advantageously be formed of a metal or metal alloy tube—in particular of titanium or titanium alloy.

In the exchanger according to the invention, the internal wall 8 of housing 1 has at least one tangential spreader rib 18 extending in radial projection toward axis 4 over a certain thickness, in such a way as to spread the coil 5 across from this wall 8. A tangential rib such as this is also adapted in order not to inhibit any circulation of secondary liquid along the axial direction between the said wall 8 and the coil 5. In fact, in the opposite case, the tangential rib 18 would not be of specific interest (with respect to direct contact of the coil 5 with the wall 8).

In the examples shown, advantageously and according to the invention, the tangential rib 18 is a helical rib, i.e. extending in the shape of a continuous helix with non-contiguous convolutions between the two axial ends of the internal wall 8. This helical rib 18 is formed by the two shells 1*a*, 1*b*. The helical rib 18 has a pitch and/or a winding direction such that the coil 5 comes in contact with this helical rib 18 along zones of contact that are essentially punctiform. It should be noted in this regard that the invention is different from all the assemblies previously known, in which the spreading elements were also adapted to hold the shapes of the coil in order to block the convolutions with respect to the housing. In contrast, in an exchanger according to the invention, the helical rib 18 arranged on the internal wall 8 of housing 1, called the exterior rib 18, comes in contact with portions of the coil 5 that are radially at the greatest distance from the axis 4.

Thus, advantageously, the winding direction of the helical exterior rib 18 is opposite to that of the coil 5 across from it. Besides that, the pitch of the exterior helical rib 18 is greater than that of the coil 5, e.g. between 1.5 and three times that of the coil 5 across from it. Because of this, the circulation of the secondary liquid in the exchange cavity 9 can be carried out along the axial direction. Nevertheless, the helical rib initiates disturbance in this axial circulation and turbulent movements of the secondary liquid around the tube forming the coil 5, which promotes thermal exchange.

In the same way, the wall 7 of core 6 is equipped with a tangential rib 19, also advantageously in the form of a helical rib with winding direction opposite to that of the coil 5, i.e. identical to that of the helical rib 18 of the internal wall 8 of the housing 1.

Thus, in the examples shown and according to the invention, in the exchange cavity 9, the internal wall 8 of the housing 1 has a helical spreader rib, called the exterior rib 18 and the core 6 has a helical spreader rib called the interior rib 19.

Preferably, advantageously and according to the invention, the pitch of the interior rib 19 is different from the pitch of the exterior rib 18. In particular, good results have been obtained with an exterior rib 18 having a pitch greater than that of the interior rib 19, it being greater than the pitch of the coil 5 contained in the exchange cavity 9. The third embodiment shown in FIGS. 10 to 12 differs from the first embodiment shown in FIGS. 1 to 6 by the number of convolutions of coil 5, which is less. In this case, the coil is shorter in length and one 17 of its axial ends can leave the shell 1*a* through a hole 16 located axially at an appropriate distance from the other hole 12 provided at the axial end 10 of shell 1*a*. The thermal power of the exchanger is lower. However, it should be noted that the core 6 and the shells 1*a*, 1*b* can remain similar to those of other embodiments, with the advantage of a low production cost. Other embodiment examples are possible. For example, it is possible to provide other variations of implementation in which the number and/or the pitch of the ribs and/or their winding direction are different from those shown.

The coil 5 is thus in contact with the interior rib 19 along the essentially punctiform contact zones and does not come into direct contact with the wall 7 of core 6. These helical ribs 18, 19 allow the axial circulation of the secondary liquid, but create turbulent movement in this secondary liquid around the tube of coil 5.

Preferably, each tangential rib 18, 19 has a contact surface with the coil 5, which is flat. Advantageously, the transverse cross section of each tangential rib 18, 19 is polygonal, in particular rectangular, square or trapezoidal.

At the same time, it is advantageous to maintain the relative axial spread of the different convolutions of the coil 5 to prevent any vibration or displacement phenomena of these convolutions at the time of secondary liquid circulation in the exchange cavity 9. Because of that, advantageously, the exchange cavity 9 is provided with at least one series of blocks 20 that are adapted so that they can be intercalated between the convolutions of coil 5 in such a way to maintain the relative axial spread. Advantageously, these blocks 20 can be shaped so that they project from the internal wall 8 of housing 1, radially toward the inside (i.e. toward axis 4), e.g. on each side of joint plane 2 on each of the shells 1*a*, 1*b*. These blocks 20 can be formed, for example, of partitions that are thin and adapted radially to hold the tube of coil 5 between them.

The coil 5 is thus properly blocked on the inside of the exchange cavity 9, on one hand radially between the exterior 18 and interior 19 ribs and on the other, axially by the blocks 20.

It should be noted that the blocks 20 do not extend over the entire periphery of the internal wall 8, in order not to inhibit the axial circulation of the secondary liquid in the exchange cavity 9.

In the examples shown in FIGS. 1 to 6 and 10 to 12, the exchanger comprises a single exchange cavity 9 and a single coil 5 with a single central core 6. The radial length of the exchange cavity 9 can be on the order of 10 mm to 15 mm and the exterior diameter of the cross section of the tube forming the coil 5 is on the order of 7 mm to 13 mm. The radial thickness of each rib 18, 19 can be between 1 mm and 3 mm.

However, it should be noted that the invention is also completely applicable to an exchanger equipped with several exchange cavities 9, with several coils installed in parallel or in series. The principle of the invention, consisting of providing tangential spreader ribs on the core 6 and on the internal wall 8 of the housing, can be applied to any exchange cavity shape.

The housing 1 and the core 6 can be made of a synthetic molded material—in particular of polyamide—which has the advantage of light weight, low cost, high rigidity and high durability, and also make possible the production of the two shells 1*a* and 1*b* and their welding to each other, e.g. by vibration welding. This weld has a good seal, is reliable and has a long service life.

The ends 13, 17 of the coil 5 cross the holes 12, 16 corresponding to the housing 1. A sealed connection is advantageously screwed onto each hole 12, 16 around each tubular end of coil 5, on the external side. A sealed connection of this type is well known.

The invention is advantageously applicable to the production of a condenser for heat exchange pump for reheating the water in a swimming pool. In this case, one of the holes 11, 15 is connected to the heat pump circuit to form an inlet for the water into the exchange cavity 9 and the other hole 15, 11 forms the water output from this exchange cavity 9. The water enters the exchange cavity 9 essentially in the form of steam and comes out essentially in liquid form. The ends of each coil 5 are connected to a primary fluid circuit which, in the example, is a refrigerant making it possible to cool the water as it passes into the exchange cavity 9. Preferably, the circulation in the coil 5 occurs as a counter-current to the circulation of the water in exchange cavity 9. Thus, the end 17 of each coil 5 located at the same axial end of the housing 1 as the water output 15 makes up the inlet for primary fluid into the coil 5 and this primary fluid leaves by the opposite end 13 of the coil 5 which is at the same axial end as the water inlet 11.

The invention may be the object of very numerous embodiment variations and other applications than those described above and shown in the figures.

For example, the helical ribs 18, 19 can be replaced by tangential ribs in the form of toroidal or annular sectors extending in the radial planes with respect to axis 4 and interposed alternately along the internal wall 8 of housing 1 and of core 6. In the same way, instead of continuous helical ribs, it is possible to provide ribs that are a portion of interrupted and/or offset spirals with different pitches or not . . . The exchange housing, the coil(s) and the core can be neither asymmetrical around one axis nor cylindrical, or may be cylindrical with non-circular base . . .

EXAMPLE

Comparative tests are carried out between a heat exchanger, called control exchanger, according to the first embodiment of the invention and a thermal exchanger, called the standard exchanger, similar to the test exchanger except as regards the winding direction of the tangential ribs and the winding direction of the coil, which in the standard exchanger, are oriented in the same winding direction, in contrast to the invention.

It is possible to circulate water at 24° C. with a feed rate of 5 $m^3$/hour into the exchange cavity of each of these test exchangers and allowing to circulate, in counter-current to the circulation of the water in the exchange cavity, water at 90° C. with a feed rate of 10 $m^3$/hour in the coil. After a period of reaching the set temperature of about 15 minutes for the test exchanger and the standard exchanger, at least five measurements are taken of the temperature of the secondary liquid coming from each of the test thermal exchangers at regular intervals over a period of one hour. An average of the temperature obtained at the output of each thermal exchanger is calculated using these measurements.

It is confirmed that the secondary liquid at the output of the test exchanger has an average temperature that is 1.5° C. greater than that of the secondary liquid coming from the standard exchanger. This temperature difference corresponds to an increase in thermal power of 8.7% for the test exchanger in comparison to the standard exchanger.

The invention claimed is:

1. A heat exchanger comprising:

an outer housing comprising an internal wall defining at least one internal chamber, incorporating at least one core having one wall defining, in the chamber, with the internal wall of the housing across from it, at least one exchange cavity, in each exchange cavity at least one tubular hollow helical pipe coil having ends that pass through the housing in order to be able to be supplied with a primary fluid circulating in this coil, at least one inlet at one axial end of the exchange cavity and at least one outlet at the other opposite axial end of the exchange cavity, in such a way that a circulation of secondary liquid can be established in an axial circulation direction in the exchange cavity between this inlet and this outlet, in contact with and on the outside of each coil that it holds, spreader elements of each coil and of the internal wall of the housing and/or of the wall of the core across from it, the spreader elements comprise at least one spreader rib, called the tangential rib, extending in projection with respect to a wall oriented across from the corresponding coil and not parallel to the axial circulation direction, but being adapted so that it does not inhibit any circulation of the secondary liquid along the axial circulation direction between the said wall and the coil, the spreader elements comprise at least one tangential helical spreader rib extending projecting from a wall arranged across from a coil, this tangential helical rib and this coil have different winding directions in such a way as to be in contact with contact zones that are essentially punctiform.

2. The exchanger according to claim 1, wherein the winding direction of at least one tangential helical spreader rib is opposite to that of the coil across from it.

3. The exchanger according to claim 1, wherein the tangential helical rib and the coil have different pitches in such a way as to be in contact along contact zones that are essentially punctiform.

4. The exchanger according to claim 3, wherein the pitch of at least one tangential helical spreader rib is greater than that of the coil across from it.

5. The exchanger according to claim 4, wherein the pitch of at least one tangential helical spreader rib is between 1.5 and 3 times as large of that of the coil across from it.

6. The exchanger according to claim 1, wherein each core comprises at least one tangential spreader rib, called the interior rib.

7. The exchanger according to claim 1, wherein in each exchange cavity, the interior wall of the housing has at least one tangential spreader rib, called the exterior rib.

8. The exchanger according to claim 1, wherein in at least one exchange cavity, the core has at least one tangential spreader rib, called the interior rib and the internal wall of the housing has at least one tangential spreader rib called the exterior rib.

9. The exchanger according to claim 8, wherein each exchange cavity has at least one interior rib and at least one exterior rib.

10. The exchanger according to claim 8, wherein:

the tangential helical ribs and the coil have different pitches in such a way as to be in contact along contact zones that are essentially punctiform, the exchange cavity has an interior helical rib and an exterior helical rib and the pitch of the interior rib is different from the pitch of the exterior rib.

11. The exchanger according to claim 10, wherein the pitch of the exterior rib is greater than the pitch of the interior rib, which itself is greater than the pitch of the coils contained in the exchange cavity.

12. The exchanger according to claim 10, wherein the exterior rib and the interior rib have the same winding direction.

13. The exchanger according to claim 11, wherein the exterior rib and the interior rib have the same winding direction.

14. The exchanger according to claim 1, wherein for each internal chamber the housing comprises two shells each forming half a cylinder and assembled with each other by way of an axial joint plane.

15. The exchanger according to claim 14, wherein the housing is equipped with holes for passage of the ends of the coil, orthogonal to the axis of the internal chamber.

16. The exchanger according to claim 1, wherein at least one exchange cavity is equipped with at least one series of blocks adapted so that they can be intercalated between the convolutions of the coil in such a way as to maintain the relative axial spread.

17. The exchanger according to claim 16, wherein the exchange cavity has blocks projecting from the internal wall of the housing.

18. The exchanger according to claim 1, comprising a single exchange cavity containing a single coil, the exchange cavity having a radial length corresponding at least essentially to the radial thickness of the exterior and interior tangential ribs and the diameter of the cross-section of the tube forming the coil.

19. The exchanger according to claim 1, wherein in at least one internal chamber, the internal wall of the corresponding housing, the exchange cavity, each core and its wall, each coil and each tangential rib are globally cylindrical around a same axis parallel to the axial circulation direction.

20. The exchanger according to claim 1, wherein the radial length of an exchange cavity is on the order of 10 mm to 15 mm and the exterior diameter of the cross section of the tube forming the coil of this exchange cavity is on the order of 7 mm to 13 mm.

21. The exchanger according to claim 1, wherein the radial thickness of each tangential spreader rib is between 1 mm and 3 mm.

22. The exchanger according to claim 1, wherein the housing and each core are made of molded synthetic material and each coil is made of a metal or a metal alloy.

* * * * *